US011684813B2

(12) United States Patent
Haslam

(10) Patent No.: US 11,684,813 B2
(45) **Date of Patent: *Jun. 27, 2023**

(54) JUMP ROPE WITH SPRING-SUPPORTED COLLET HANDLE

(71) Applicant: Ryan Haslam, Bountiful, UT (US)

(72) Inventor: Ryan Haslam, Bountiful, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/896,985

(22) Filed: Aug. 26, 2022

(65) Prior Publication Data

US 2022/0401780 A1 Dec. 22, 2022

Related U.S. Application Data

(63) Continuation of application No. 16/635,637, filed as application No. PCT/US2018/061324 on Nov. 15, 2018, now Pat. No. 11,458,344.
(Continued)

(51) Int. Cl.
*A63B 5/20* (2006.01)
*A63B 21/00* (2006.01)
(Continued)

(52) U.S. Cl.
CPC ..... *A63B 5/20* (2013.01); *A63B 21/023* (2013.01); *A63B 21/0428* (2013.01);
(Continued)

(58) Field of Classification Search
CPC ..... A63B 5/20; A63B 5/205; A63B 15/00; A63B 15/005; A63B 15/02; A63B 21/0004; A63B 21/00043; A63B 21/00185; A63B 21/02; A63B 21/023; A63B 21/025; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/0608; A63B 21/08; A63B 21/22; A63B 21/4027;
(Continued)

(56) References Cited

U.S. PATENT DOCUMENTS 700,412 A 5/1902 Fischer
2,463,144 A 3/1949 Buchanan
(Continued)

FOREIGN PATENT DOCUMENTS

CN 202715169 U 2/2013
CN 104274936 A 1/2015
(Continued)

*Primary Examiner* — Gary D Urbiel Goldner
(74) *Attorney, Agent, or Firm* — Steven L. Nichols; Fabian VanCott

(57) ABSTRACT

In one example in accordance with the present disclosure, a jump rope handle assembly is described. The jump rope handle assembly includes a handle having a longitudinal axis. A shaft assembly is disposed within the handle. The shaft assembly is to receive a jump rope section and is to rotate and slide within the handle. The shaft assembly includes a collet to retain the jump rope section. The jump rope handle assembly also includes a spring to compress between the shaft assembly and an interior impact surface of the handle.

20 Claims, 12 Drawing Sheets

Related U.S. Application Data

(60) Provisional application No. 62/588,610, filed on Nov. 20, 2017.

(51) Int. Cl.
*A63B 21/02* (2006.01)
*A63B 21/04* (2006.01)
*A63B 71/00* (2006.01)

(52) U.S. Cl.
CPC .. *A63B 21/4035* (2015.10); *A63B 2071/0063* (2013.01); *A63B 2209/00* (2013.01); *A63B 2225/09* (2013.01)

(58) Field of Classification Search
CPC ..... A63B 21/4033; A63B 21/4035; A63B 21/4045; A63B 21/4047; A63B 21/4049; A63B 71/0054; A63B 2071/0063; A63B 2071/0072; A63B 2071/0694; A63B 2209/00; A63B 2209/02; A63B 2209/023; A63B 2209/026; A63B 2225/09
See application file for complete search history.

(56) References Cited

U.S. PATENT DOCUMENTS

| | | | | |
|---|---|---|---|---|
| 2,645,832 | A | 7/1953 | Lee | |
| 3,220,743 | A | 11/1965 | Bernard | |
| 3,374,511 | A | 3/1968 | Kenneth | |
| 3,517,931 | A | 6/1970 | Kalish | |
| 3,852,850 | A | 12/1974 | Filhaber | |
| 4,141,117 | A | 2/1979 | Van Gompel | |
| 4,158,457 | A | 6/1979 | Hydro | |
| 4,179,119 | A | 12/1979 | Wolf | |
| 4,330,118 | A | 5/1982 | Race | |
| 4,375,886 | A | 3/1983 | Muys | |
| 4,505,474 | A | 3/1985 | Mattox | |
| 4,563,002 | A | 1/1986 | Jardine | |
| 4,593,899 | A | 6/1986 | Miller | |
| 4,605,219 | A | 8/1986 | Mahana | |
| 4,637,606 | A | 1/1987 | Hunn | |
| 4,736,945 | A | 4/1988 | Vinciguerra | |
| 4,801,137 | A | 1/1989 | Douglass | |
| 4,872,666 | A | 10/1989 | Smith | |
| 4,934,691 | A | 6/1990 | Rudd | |
| 5,015,023 | A | 5/1991 | Hall | |
| 5,054,772 | A | 10/1991 | Winston | |
| 5,170,537 | A | 12/1992 | Sperling | |
| 5,236,405 | A | 8/1993 | Dohmann | |
| 5,369,849 | A | 12/1994 | De France | |
| 5,417,400 | A | 5/1995 | Arakawa | |
| 5,690,592 | A | 11/1997 | Heinrich | |
| 5,697,871 | A | 12/1997 | Landfair | |
| 5,709,619 | A | 1/1998 | D'Emidio | |
| 6,113,520 | A | 9/2000 | Greiner | |
| 6,648,804 | B2 | 11/2003 | Chen | |
| 6,752,746 | B1 | 6/2004 | Winkler | |
| 7,147,580 | B2 | 12/2006 | Nutter | |
| 7,462,140 | B1 | 12/2008 | Lombardozzi | |
| 7,591,772 | B2 | 9/2009 | Shillington | |
| 7,789,809 | B2 | 9/2010 | Borth | |
| 8,043,196 | B1 | 10/2011 | Chen | |
| 8,062,193 | B2 | 11/2011 | Oesterling | |
| 8,075,455 | B2 | 12/2011 | Gamboa | |
| RE43,194 | E | 2/2012 | Toimil | |
| 8,136,208 | B2 | 3/2012 | Borth | |
| 8,684,892 | B1 | 4/2014 | Ihli | |
| 8,911,333 | B2 | 12/2014 | Hunt | |
| 9,249,577 | B2 | 2/2016 | Ross | |
| 9,884,217 | B2 | 2/2018 | Henniger | |
| 10,071,274 | B2 | 9/2018 | Nurse | |
| 10,315,061 | B2 | 6/2019 | Yu | |
| 10,436,231 | B2 | 10/2019 | White | |
| 11,458,344 | B2 * | 10/2022 | Haslam | A63B 5/20 |
| 2003/0148859 | A1 | 8/2003 | Chun | |
| 2005/0014571 | A1 | 1/2005 | Varner | |
| 2005/0071958 | A1 | 4/2005 | Toimil | |
| 2006/0128534 | A1 | 6/2006 | Roque | |
| 2007/0191195 | A1 | 8/2007 | St. George | |
| 2009/0247372 | A1 | 10/2009 | Borth | |
| 2010/0230395 | A1 | 9/2010 | Mukai | |
| 2012/0202661 | A1 | 8/2012 | Jordan | |
| 2013/0303330 | A1 | 11/2013 | Stevens | |
| 2015/0119206 | A1 | 4/2015 | Newman | |
| 2015/0201985 | A1 | 7/2015 | Rampersaud | |
| 2015/0224355 | A1 | 8/2015 | Holland | |
| 2016/0067536 | A1 | 3/2016 | Carpinelli | |
| 2016/0324546 | A1 | 11/2016 | Simpson | |
| 2017/0151457 | A1 | 6/2017 | Harguth | |
| 2018/0161613 | A1 | 6/2018 | Newman | |
| 2021/0121724 | A1 * | 4/2021 | Haslam | A63B 21/0428 |

FOREIGN PATENT DOCUMENTS

| | | | | |
|---|---|---|---|---|
| CN | 205307681 | U | 6/2016 | |
| CN | 206444056 | U | 8/2017 | |
| KR | 200182143 | Y1 | 3/2000 | |
| KR | 1020020088250 | A | 11/2002 | |
| KR | 1020030040928 | A | 5/2003 | |
| KR | 101770509 | B1 | 8/2017 | |
| KR | 102135165 | B1 * | 7/2020 | A63B 21/023 |
| RU | 135927 | U1 | 12/2013 | |
| WO | 2017151709 | A1 | 9/2017 | |
| WO | WO-2019099701 | A1 * | 5/2019 | A63B 21/023 |

* cited by examiner

JUMP ROPE WITH SPRING-SUPPORTED COLLET HANDLE

RELATED APPLICATIONS

The present application is a continuation of U.S. application Ser. No. 16/635,637 filed Jan. 31, 2020, which is a national stage entry of PCT/US2018/061324 filed Nov. 15, 2018, which claims the benefit of U.S. Provisional Application No. 62/588,610 filed Nov. 20, 2017. These applications are incorporated herein by reference in their entireties.

BACKGROUND

Jump ropes are a staple at many commercial gyms and home gyms and have been for many years. A user grips the handles of the jump rope and via arm motion, manipulates the movement of the rope. For example, a user can swing the rope over the top of the user's head and then under the user's feet in a variety of patterns as the user jumps. Use of a jump rope improves a user's overall fitness specifically enhancing coordination, user reflex, muscular tone, and cardiovascular endurance.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
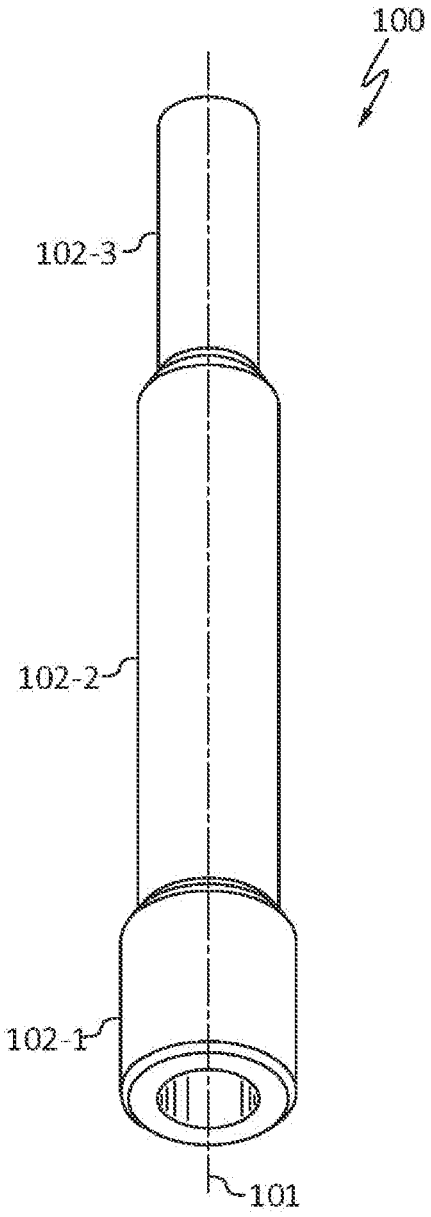
FIG. 1 is an isometric view of the jump rope handle, according to an example of the principles described herein.

The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Jump ropes are a staple at many commercial gyms and home gyms and have been for many years. A user grips the handles of the jump rope and via arm motion, manipulates the movement of the rope. For example, a user can swing the rope over the top of the user's head and then under the user's feet in a variety of patterns as the user jumps. Use of a jump rope improves a user's overall fitness specifically enhancing coordination, user reflex, muscular tone, and cardiovascular endurance.

The feel and performance of a jump rope can have a large effect on the impact of a jump rope to a user's workout. For example, some jump ropes, by having an unnatural feel, or that result in sudden, abrupt changes in motion in a certain direction, i.e., a jerk, can interrupt a user's workout, thus resulting in a less than satisfactory experience. Moreover, depending on a desired workout, a user may wish to have jump ropes of different lengths. However, jump ropes generally are not adjustable in length. Depending on the user, a jump rope may be extensively used. For example, a boxer may place heavy stresses on the jump rope. In these situations, and under general use, the jump rope may wear down over time and ultimately may break. Experienced users may also have particular preferences for their jump rope and traditional jump ropes may prove too heavy for effective training.

Accordingly, the present specification describes a jump rope that solves these and other complications. Specifically, the jump rope of the present specification provides for a natural "feel." The jump rope of the present specification includes a rope section that is connected to handle assemblies at either end. The handle assemblies include various components that increase the performance of the jump rope. For example, a shaft assembly rotates and slides within a handle thus preventing the twisting of the jump rope. The shaft assembly includes components that allow for the rope to be inserted and affixed. For example, a threaded collet on the shaft allows for the rope to be inserted and affixed. In another example a collated fitting is inserted into a receptacle to affix the jump rope in place. Such handle assemblies provide for one continuous section of jump rope that does not include articulating joints, thus improving the responsiveness of the jump rope. Other benefits are described herein.

Specifically, the present specification describes a jump rope handle assembly. The handle assembly includes a handle having a longitudinal axis and a shaft assembly disposed within the handle. The shaft assembly 1) is to receive a jump rope section and 2) is to rotate and slide within the handle. The shaft assembly includes a collet to retain the jump rope section. The jump rope handle assembly also includes a spring to compress between the shaft assembly and an interior impact surface of the handle.

The present specification also describes a jump rope assembly. The jump rope assembly includes a jump rope section with ends coupled to handle assemblies. The jump rope section is to be passed over an individual. The jump rope assembly includes two handle assemblies. Each handle assembly includes a handle having a longitudinal axis and that has varying diameters along its longitudinal axis. Each handle assembly also includes a shaft assembly disposed within each handle. Each shaft assembly is to receive a jump rope section and is slidable and rotatable inside the corresponding handle. The shaft assembly includes a collet to retain the jump rope section. A spring of each handle assembly compresses between the respective shaft assembly and an interior impact surface of the handle.

The present specification also describes another example of a jump rope assembly. In this example, the jump rope assembly includes a jump rope section with ends coupled to handle assemblies, the jump rope section to be passed over an individual. The jump rope assembly also includes two handle assemblies. Each handle assembly includes a handle having a longitudinal axis, the handle incrementally varying in diameter along its longitudinal axis. Each handle assembly also includes a shaft assembly disposed within the handle. Each shaft assembly includes 1) a collet fitting to receive the jump rope section and 2) a fitting receptacle to receive the collet fitting to tighten the collet fitting about the jump rope section. In this example, the shaft assembly is to rotate and slide within the handle. Each handle assembly also includes 1) a spring to compress between the shaft assembly and an interior impact surface of the handle and 2) an external spring projecting out of the handle to prevent kinking of the jump rope section.

In a specific example, the shaft assemblies retain opposing ends of a jump rope section via a compression nut and a threaded collet, thus allowing for easy adjustment of the length of the rope. The rope itself is galvanized steel with a vinyl coating with a 7×19 stranding. A spring is disposed around the shaft assembly and interfaces with an interior surface of the handle and the compression nut to absorb shock when the rope is in use.

Figure 2:
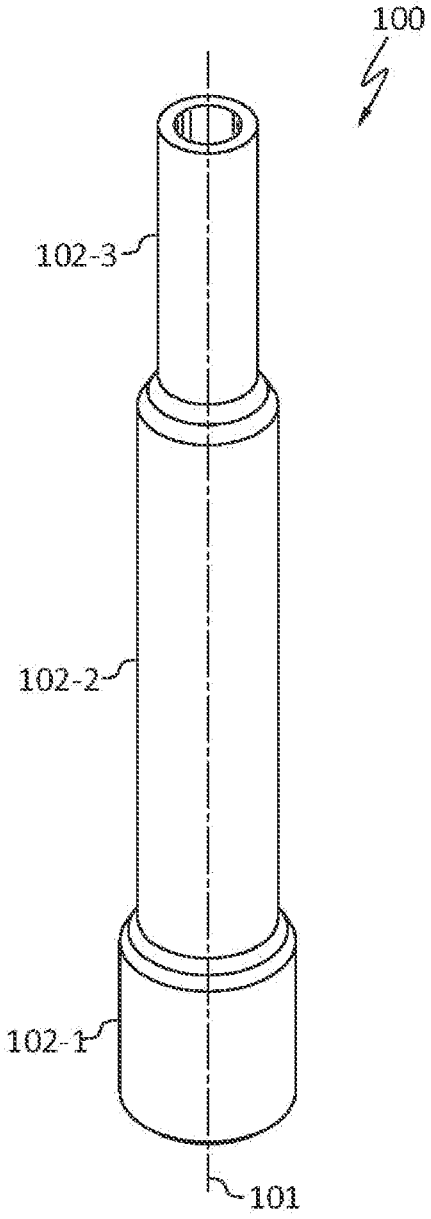
FIG. 2 is another isometric view of the jump rope handle, according to an example of the principles described herein.

Turning now to the figures, FIGS. 1 and 2 are isometric views of the jump rope handle (100), according to an example of the principles described herein. The handle (100) is sized to fit into the hand of a user with little to no extension beyond the palm and thumb of the user when gripped. The handle (100) has a longitudinal axis (101). Going along the longitudinal axis, the handle (100) may change diameters, in some cases incrementally. In one example, the handle (100) has a distal portion (102-1), which refers to that end which is furthest from the entry of the rope section into the handle (100), a middle portion (102-2), and a proximal portion (102-3), which proximal portion (102-3) refers to that portion which receives the rope section. In this example, the distal portion (102-1) may have a diameter that is larger than a diameter of the middle portion (102-2). The middle portion (102-2) also has a diameter, which diameter may be larger than the diameter of the proximal portion (102-3). Such an incrementally decreasing diameter size increases a user's grip on the handle (100) and enhance a user's control over the jump rope.

The handle (100) may be formed of various materials including a polyoxymethylene. Polyoxymethylene is a lightweight plastic that is easily machineable. This material has excellent dimensional stability and a low frictional coefficient. The low frictional coefficient improves the relative motion of the shaft within the handle (100) as will be described below. While specific reference is made to particular materials, in some examples, the handle (100) may be formed of different materials. The handle (100) also serves as an outer race for the shaft to rotate within. That is, the handle (100) may be a hollow cylinder having a certain thickness. The shaft is inserted into the handle (100) which shaft receives the jump rope. More detail regarding the interface between the shaft and the handle (100) is provided below in connection with FIGS. 6-8.

Figure 3:
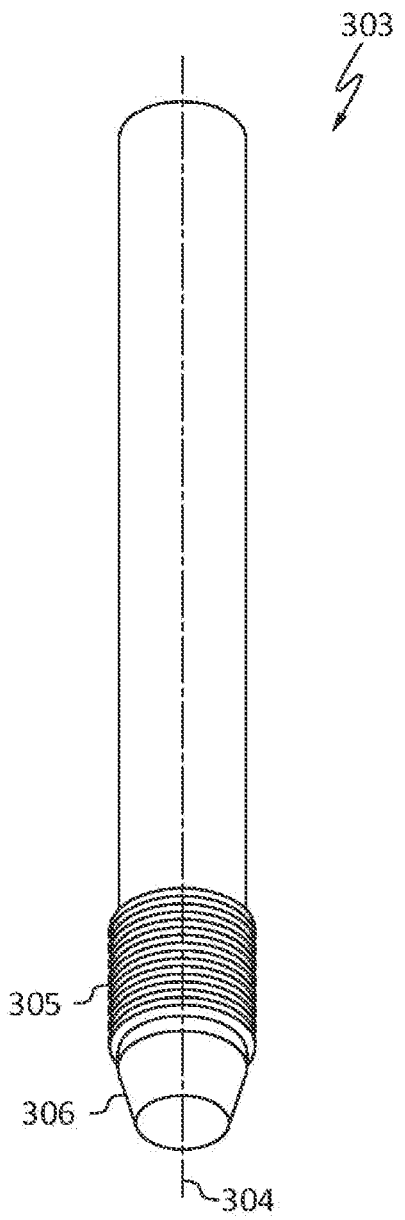
FIG. 3 is an isometric view of the shaft that retains the jump rope, according to an example of the principles described herein.

FIG. 3 is an isometric view of the shaft (303) that retains the jump rope, according to an example of the principles described herein. The shaft (303) is an elongated body that may be shorter, along its longitudinal axis (304) than the handle (FIG. 1, 100). The shaft (303) is also hollow so as to receive the jump rope. The inside diameter of the shaft (303) may match, or be slightly larger than the outside diameter of the jump rope that is received therein.

One end (306) of the shaft (303) may be tapered. The shaft (303) may be made of a corrosion resistant metal. The outer surface of the shaft (303) provides a smooth surface against the handle (FIG. 1, 100) as the shaft (303) rotates therein. That is, as a user manipulates the handles (FIG. 1, 100) to rotate the jump rope, the coupled shaft (303) rotates as well. Allowing the shaft (303) to rotate within the handle (FIG. 1, 100) prevents twisting of the jump rope. The shaft (303) may also slide inside the handle (FIG. 1, 100).

The inside of the shaft (303) encloses an end of the jump rope. In some examples, the rope is retained within the shaft (303) via a threaded collet (305) and a compression nut. That is, the threaded collet (305) may have a diameter that tapers away from the end (306) that receives the rope. That is, the end (306) gets larger towards an interior portion of the shaft (303). The threaded collet (305) encompasses the jump rope inside the handle (FIG. 1, 100). Once the jump rope is inserted to a desired location, a compression nut engages with the threaded collet (305) to compress the walls of the threaded collet (305) and the end (306) against the jump rope, thus securing the jump rope in place. Such a locking mechanism is done without tools and thus allows for quick, on the spot, rope-length adjustment. Moreover, such a connection is free of an articulating joint. That is, there is no articulation about a joint. Such a joint can impede responsiveness of the system. Accordingly, the lack of such an articulating joint improves responsiveness of the jump rope during use.

Figure 4:
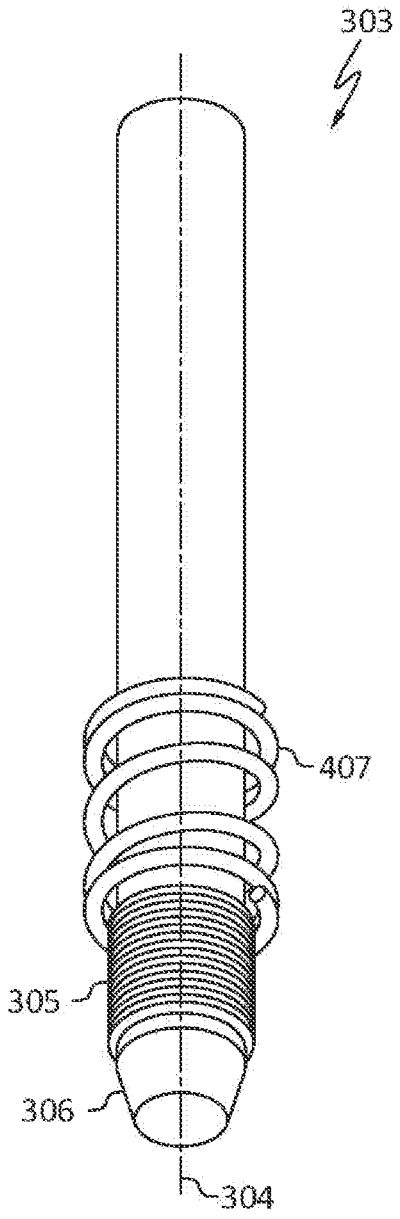
FIG. 4 is an isometric view of the shaft that retains the jump rope and the spring, according to an example of the principles described herein.

FIG. 4 is an isometric view of the shaft (303) that retains the jump rope and the spring (407), according to an example of the principles described herein. As described above, the handle (FIG. 1, 100) also houses a spring (407) which acts as a tension reliever for the jump rope when in use. For example, as a user rotates the jump rope, physical forces operate to pull the shaft (303) against an interior surface of the handle (FIG. 1, 100). The impact force of the shaft (303) against this interior surface can result in an unnatural force of the handle (FIG. 1, 100) against the intended movement by the user. The spring (407) dampens this force, thus increasing the responsiveness and control of the jump rope assembly. That is, the spring (407) acts as a shock absorber when the jump rope is quickly accelerated. This helps soften the "jerking" action transmitted to the end of the jump rope during rapid directional changes performed by the user. This helps the jump rope stay in better rhythm with the users arm and foot movements. More detail regarding the spring (407) and handle (FIG. 1, 100) contact is described below in connection with FIGS. 6-8.

Figure 5:
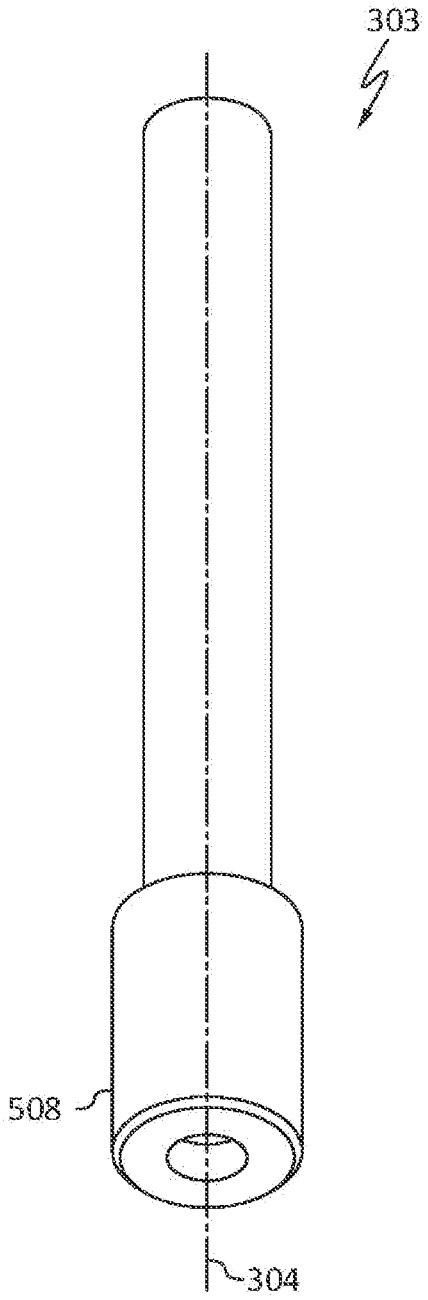
FIG. 5 is an isometric view of the shaft with the compression nut in place, according to an example of the principles described herein.

FIG. 5 is an isometric view of the shaft (303) with the compression nut (508) in place, according to an example of the principles described herein. As described above, via a threaded collet (FIG. 3, 305), the jump rope is retained by the shaft (303). The compression nut (508) is rotated in one direction and engages the threads to compress the shaft (303) circumferentially against the rope jump. The compression nut (508) can be rotated in an opposite direction to release the shaft (303) from the jump rope. Thus, in this fashion the length of the jump rope can be adjusted by removing the compression nut (508) from the shaft (303), adjusting the length of the rope, and re-tightening the compression nut (508). All this can be done without any tooling, on the fly. Accordingly, a jump rope length can be adjusted as desired and on-the-spot. In some examples, the compression nut (508) includes a hole through which the jump rope passes. In this example, a user need not cut the jump rope when making any rope length adjustments.

Figure 6:
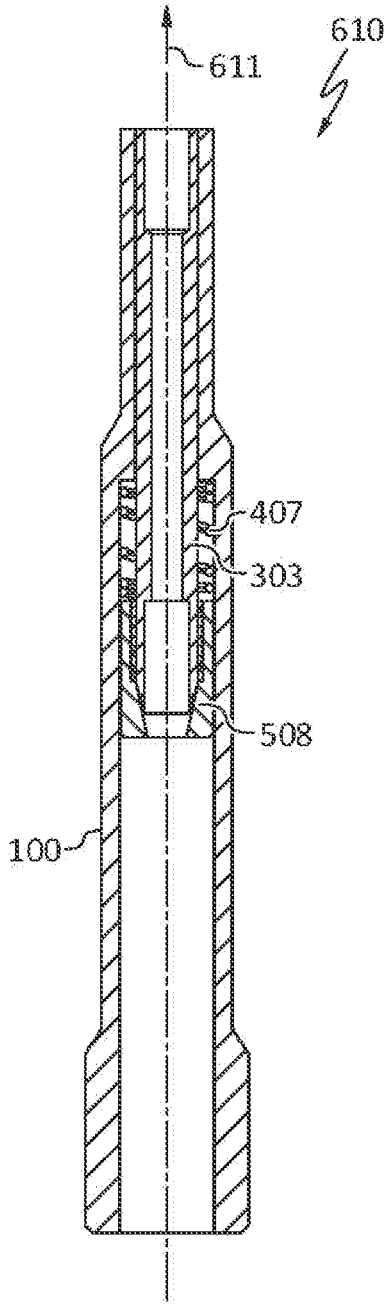
FIGS. 6-8 are diagrams of the handle assembly with the shaft, compression nut, and spring disposed therein, according to an example of the principles described herein.
Figure 7:
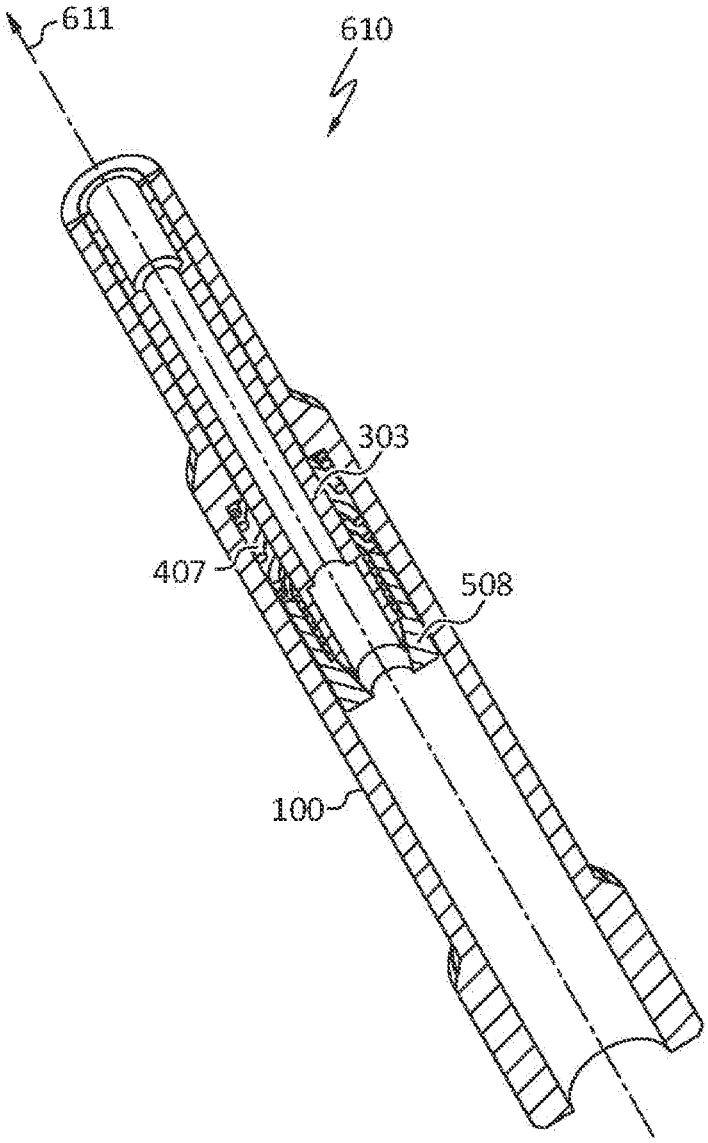
Figure 8:
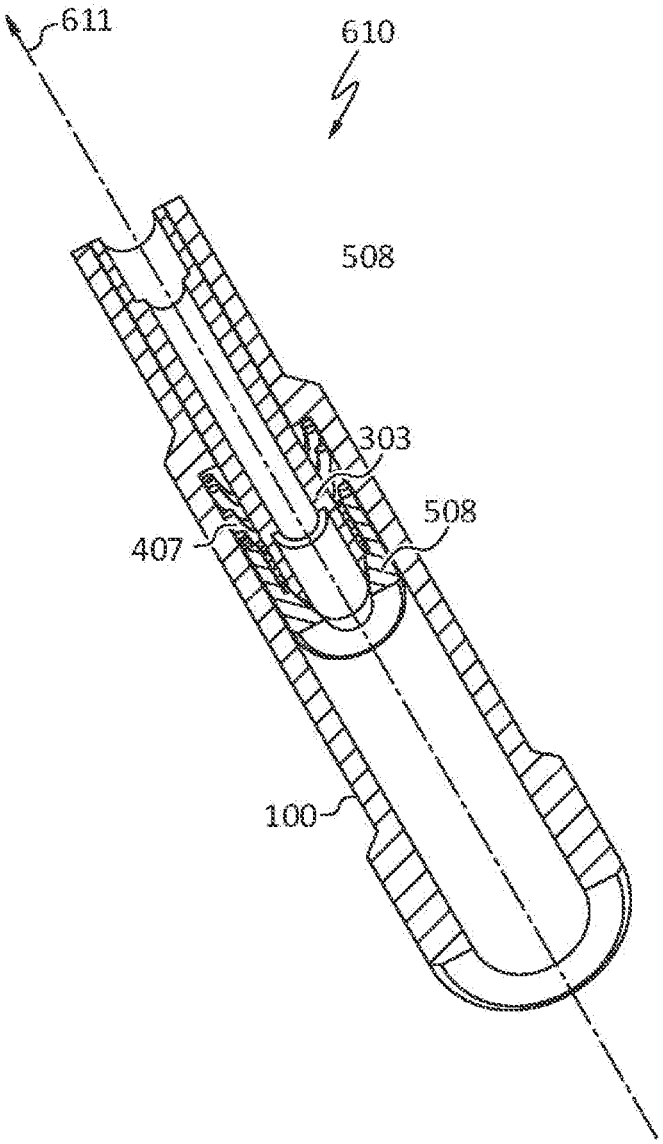

FIGS. 6-8 are diagrams of the handle assembly (610) with the shaft (303), compression nut (508), and spring (407) disposed therein, according to an example of the principles described herein. As described above, the handle assembly (610) includes a handle (100) with a shaft (303) disposed therein. Also included are the spring (407) and the compression nut (508) described above. As described above, the handle assembly (610) includes a handle (100) having a longitudinal axis and a shaft assembly disposed within the handle (100). The shaft assembly is to receive a jump rope section and is to rotate and slide within the handle (100). The shaft assembly includes a collet in different forms to retain the jump rope section. FIGS. 6-8 depict an example where the shaft assembly includes a collected shaft and a compression nut (508). The handle assembly (610) also includes a spring (407) to compress between the shaft assembly and an interior impact surface of the handle (100).

As described above, the shaft (303) rotates and slides within the handle (100). The interface between the handle (100) and the shaft (303) is referred to as a plain bearing interface where the surfaces rub against one another. The materials of the handle (100) and shaft (303) have low coefficients of friction such that any friction force there between has a minimal impact on jump rope use and is very durable. The use of such a simple interface reduces the cost and complexity of the handle assembly (610) and the overall jump rope device. Moreover, a simple plain bearing interface increases responsiveness as other types of bearings, such as ball bearings, can introduce force loss in the system. That is, the use of ball bearings increase cost, decrease responsiveness of the system, decrease handle ergonomics, and decrease the systems reliability.

FIGS. 6-8 also depict the interface between the spring (407), handle (100), and the compression nut (508). The spring (407) is disposed between an interior impact surface of the handle (100) and the compression nut (508). Accordingly, as the forces pull the jump rope out the handle (100) in the direction indicated by the arrow (611), the shaft (303) along with the compression nut (508), is pulled in the same direction. This force compresses the spring (407) against the impact surface on the interior of the handle (100). Without such a spring (407), the compression nut (508), would strike the impact surface abruptly resulting in an unnatural jarring movement of the handle (100) in the direction of the arrow (611). The spring (407) serves to dampen this force, thus resulting in a more natural movement, and better flow, during use.

Figure 9:
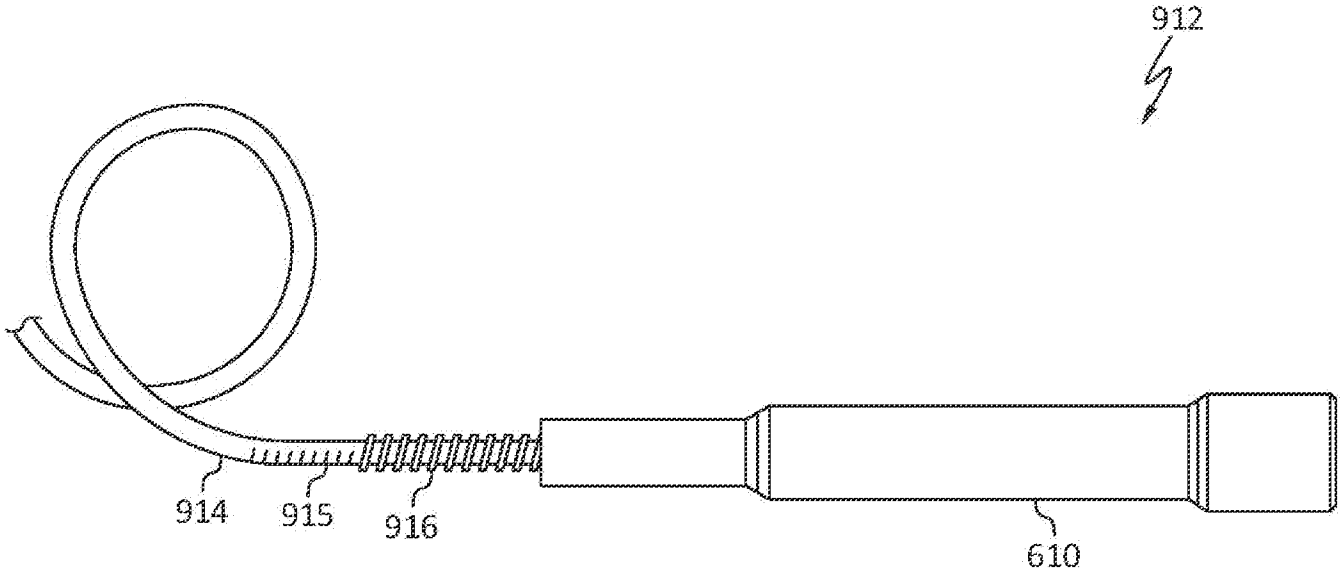
FIGS. 9-11 are diagrams of the jump rope assembly, according to an example of the principles described herein.
Figure 10:
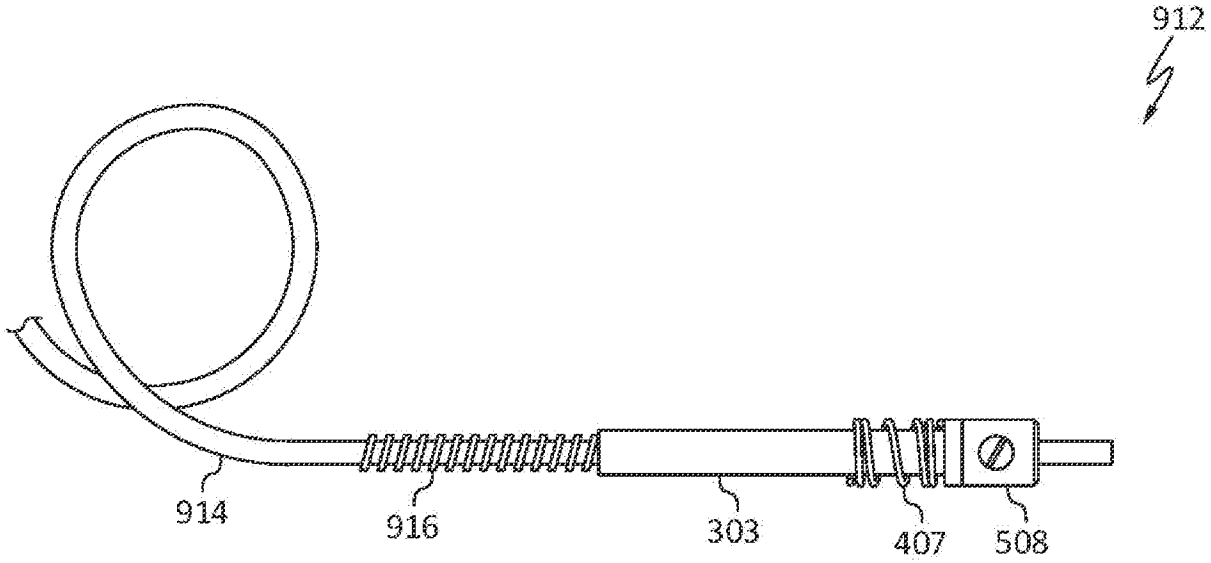
Figure 11:
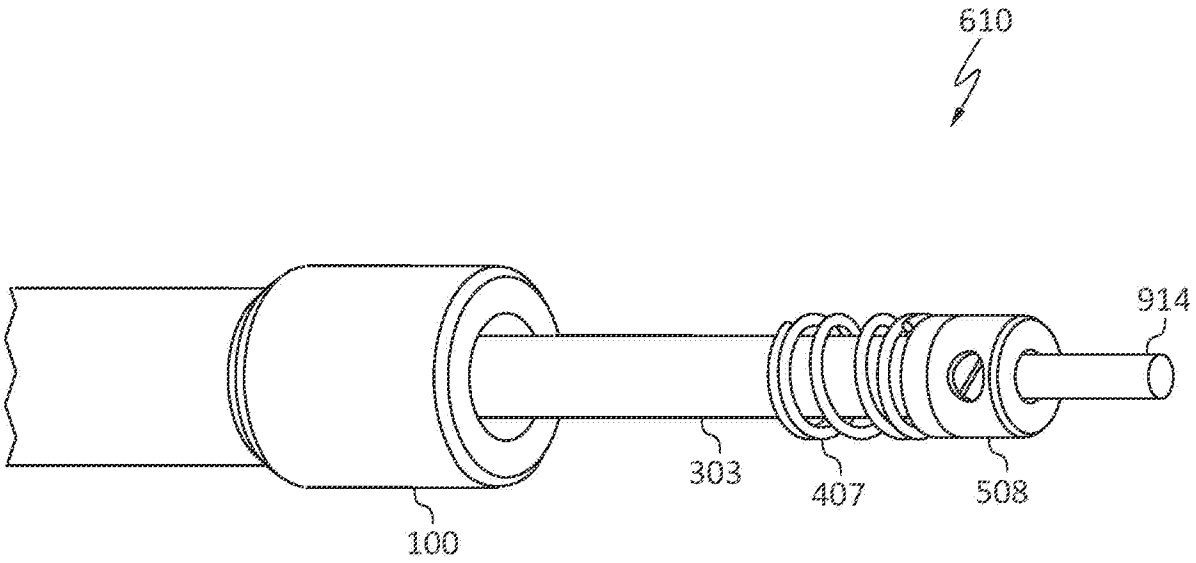

FIGS. 9-11 are diagrams of the jump rope assembly (912), according to an example of the principles described herein. As described above, the jump rope assembly (912) includes the handle assemblies (610) and corresponding components as described earlier. The jump rope assembly (912) also includes the jump rope section (914) which is manipulated by the user during use. In one example, the jump rope section (914) may be a 0.0625 inch diameter galvanized steel cable. The steel cable may be coated with a vinyl coating which brings the overall diameter to 0.120 inches. The jump rope section (914) is 7×19 stranding, which provides the flexibility and response desirable in a jump rope assembly (912). In some examples, the jump rope section (914) may have graduated markings (915) printed on each end to indicate cut lengths as well as to provide the user with a way to ensure a desired length is achieved amidst many changes to rope length.

In some examples, the jump rope assembly (912) also includes an external spring (916). This external spring (916) extends out of the handle assembly (610) and prevents the jump rope section (914) from bending at too tight of an angle, for example as a user whips the jump rope around themselves. That is, the external spring (916) provides a jump rope section (914) strain relief. The external spring (916) is fixed on the end of the shaft (303) and the jump rope section (914) is slid through it.

FIG. 10 depicts components of the handle assembly (FIG. 6, 610) with the handle (FIG. 1, 100) removed. As described above, the handle assembly (FIG. 6, 610) may include a shaft (303) that retains the jump rope section (914). In one example, the jump rope section (914) is retained within the shaft (303) via the interface between a threaded collet (FIG. 3, 305) and a compression nut (508). The spring (407) compresses between the compression nut (508) and an impact surface of the handle (FIG. 1, 100) to dampen any forces resultant from an acceleration of the jump rope section (914) during use.

FIG. 11 depicts a close of up some of the components of the handle assembly (610). Specifically, the compression nut (508), the spring (407), the shaft (303), and the jump rope section (914) extending through. FIG. 11, also depicts the handle (100) in which the shaft (303) is slideable.

The jump rope assembly (912) as described herein provides a very responsive unit. Note that all components of the jump rope assembly (912) are interchangeable. That is a rope portion may be replaced while the handle and shaft may be retained.

Figure 12:
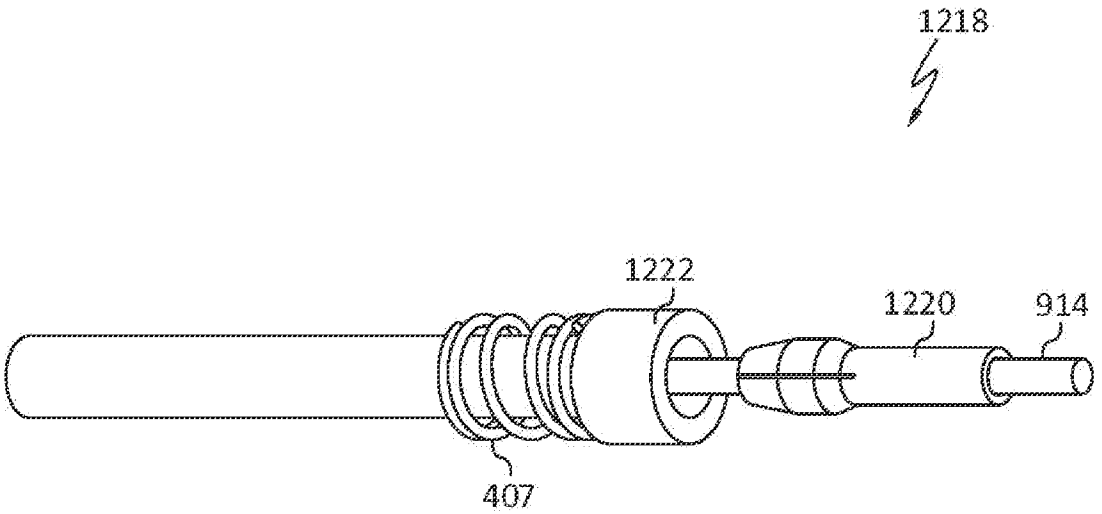
FIG. 12 is an isometric view of the shaft assembly, according to an example of the principles described herein.
Figure 13:
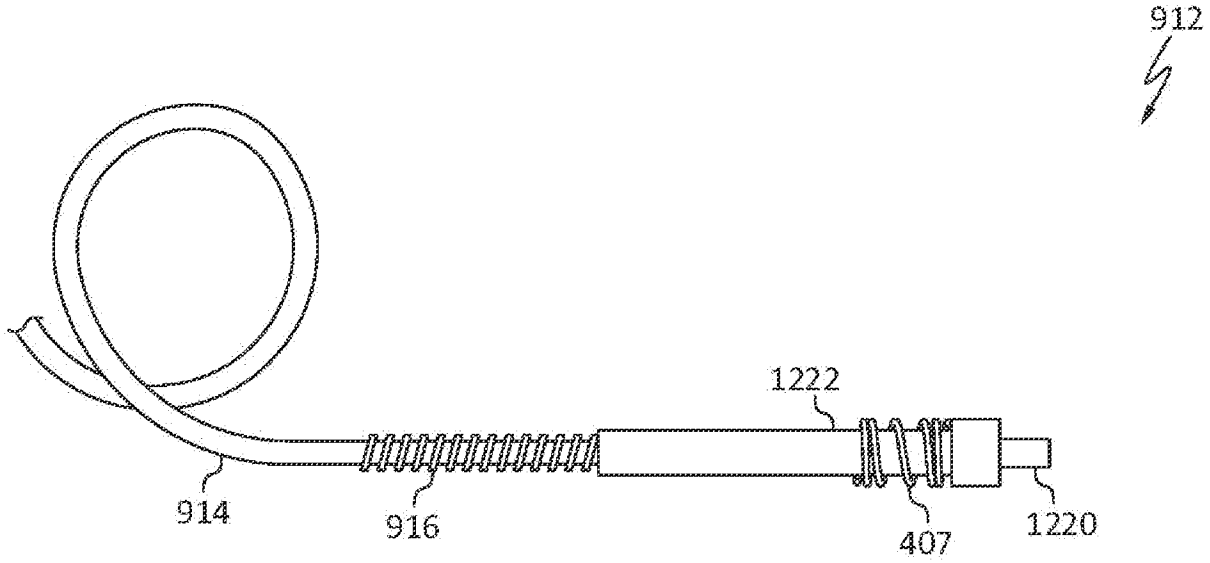
FIG. 13 is a diagram of the jump rope assembly, according to another example of the principles described herein.

FIG. 12 is an isometric view of the shaft assembly (1218). As described above, the shaft assembly (1218) may take different forms to retain the jump rope section (FIG. 9, 914). In this example, the shaft assembly (1218) includes a collet fitting (1220) to receive the jump rope section (914) and a fitting receptacle (1222) to receive the collet fitting (1220). The fitting receptacle (1222) is an elongated body that may be shorter, along its longitudinal axis than the handle (FIG. 1, 100). The shaft (1222) is also hollow so as to receive the jump rope. The inside diameter of the shaft (1222) may match, or be slightly larger than the outside diameter of the jump rope that is received therein. As with the threaded collet (FIG. 3, 305), the collet fitting (1220) may have a tapered end. Once the jump rope section (914) is inserted to a desired location, the collet fitting (1220) is pressed into the fitting receptacle (1222) as depicted in FIG. 13. This action compresses the walls of the collet fitting (1220) against the jump rope section (914) thus securing the jump rope in place. As with the compression nut (FIG. 5, 508), in some examples, the collet fitting (1220) includes an orifice through which the jump rope section (914) passes, thus allowing for an adjustment of the length of the jump rope without having to cut the jump rope.

As is clearly depicted in FIG. 12, the fitting receptacle (1222) may have an enlarged opening section to receive the collet fitting (1220). The enlarged portion also provides a surface against which the spring (407) interfaces with during use. That is, as described above, as a user rotates the jump rope, physical forces operate to pull the shaft assembly (1218) against an interior surface of the handle (FIG. 1, 100). The impact force of the shaft assembly (1218) against this interior surface can result in an unnatural force of the handle (FIG. 1, 100) against the intended movement by the user. The spring (407) dampens this force, thus increasing the responsiveness and control of the jump rope assembly. That is, the spring (407) acts as a shock absorber when the jump rope is quickly accelerated. This helps soften the "jerking" action transmitted to the end of the jump rope during rapid directional changes performed by the user. That is, the spring (407) is disposed around the shaft assembly (1218) and interfaces with an interior surface of the handle (100) and the enlarged section of the fitting receptacle (1222) to absorb shock when the rope is in use.

FIG. 13 is a diagram of a jump rope assembly (912), according to another example of the principles described herein. As described above, the fitting receptacle (1222) rotates and slides within the handle (FIG. 1, 100). The interface between the handle (100) and the fitting receptacle (1222) is referred to as a plain bearing interface where the surfaces rub against one another. As depicted in FIG. 13, the collet fitting (1220) may extend outside the fitting receptacle (1222) with the collet end disposed within the enlarged opening of the fitting receptacle (1222). FIG. 13 also depicts the external spring that prevents the jump rope section (914) from bending at too tight of an angle.

Figure 14:
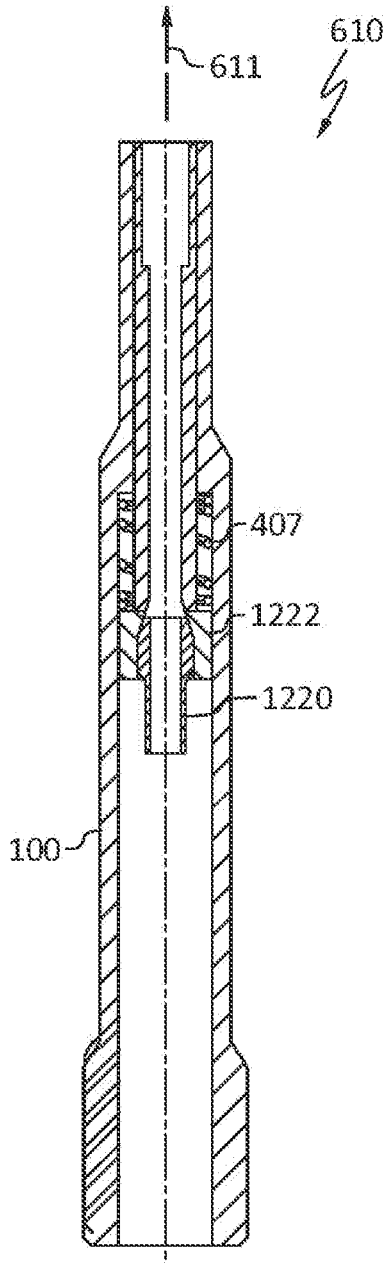
FIG. 14 is a cross-sectional view of the jump rope handle assembly, according to another example of the principles described herein.

FIG. 14 is a cross-sectional view of the jump rope handle assembly (610), according to another example of the principles described herein. The jump rope handle assembly (610) of FIG. 14 clearly depicts the jump rope section (914) with ends coupled to a handle assembly (610). In this example, the shaft assembly (FIG. 12, 1218) includes a collet fitting (1220) to receive the jump rope section (914) and the fitting receptacle (1222) to tighten the collet fitting (1220) against the jump rope section (914). In some examples, the interface between the collet fitting (1220) and the fitting receptacle (1222) may be an interference fit. That is, a user may position the jump rope section through the collet fitting (1220) which may be a brass fitting. The user may then push the collet fitting (1220) with the jump rope section disposed therein, through the fitting receptacle (1222). As the jump rope is used, the centrifugal force of the jump rope rotating pulls the jump rope section and collet fitting (1220) tighter into the fitting receptacle (1222) thus preventing any unintentional decoupling of the collet fitting (1220) and the fitting receptacle (1222).

In some examples, the fitting receptacle (1222) may be formed of a nylon material. Nylon has a low coefficient of friction, meaning that a fitting receptacle (1222) formed of nylon may rotate with low frictional forces between the fitting receptacle (1222) and the handle (100) in which it is disposed. The low frictional force results in an unencumbered, natural feel to the jump rope user. The preceding description has been presented to illustrate and describe examples of the principles described. This description is not intended to be exhaustive or to limit these principles to any precise form disclosed. Many modifications and variations are possible in light of the above teaching.

What is claimed is:

1. A jump rope handle assembly comprising:
- a handle having a longitudinal axis;
- a shaft assembly disposed within the handle, wherein the shaft assembly:
  - is configured to receive a jump rope section;
  - is operable to, as a unit, rotate and slide within the handle; and
  - comprises a collet configured to retain the jump rope section.

2. The jump rope handle assembly of claim 1, further comprising a spring operable to compress between the shaft assembly and an interior impact surface of the handle.

3. The jump rope handle assembly of claim 1, wherein the collet is a threaded collet and the shaft assembly further comprises:
- a compression nut configured to threadingly engage the threaded collet and tighten the threaded collet about the jump rope section.

4. The jump rope handle assembly of claim 3, wherein the compression nut includes an orifice configured through which the jump rope section passes.

5. The jump rope handle assembly of claim 3, wherein the compression nut is configured to be unthreaded from the threaded collet during an adjustment of a length of the jump rope section.

6. The jump rope handle assembly of claim 1, wherein the collet is a collet fitting configured to receive the jump rope section and the shaft assembly further comprises:
- a fitting receptacle configured to receive the collet fitting and tighten the collet fitting about the jump rope section.

7. The jump rope handle assembly of claim 6, wherein the collet fitting includes an orifice configured through which the jump rope section passes.

8. The jump rope handle assembly of claim 6, wherein the collet fitting has an interference fit within the fitting receptacle during use.

9. The jump rope handle assembly of claim 1, wherein the handle is formed of polyoxymethylene.

10. The jump rope handle assembly of claim 1, wherein the shaft assembly has a plain bearing interface with the handle.

11. A jump rope assembly comprising:
- a jump rope section with ends respectively coupled to two handle assemblies, the jump rope section configured to be passed over an individual;
- each handle assembly comprising:
  - a handle having a longitudinal axis, the handle incrementally varying in diameter along the longitudinal axis;
  - a shaft assembly disposed within the handle, wherein the shaft assembly:
    - is operable to receive a jump rope section;
    - is operable to, as a unit, rotate and slide within the handle in response to a force exerted on the shaft assembly by the jump rope section; and
    - comprises a collet to retain the jump rope section.

12. The jump rope assembly of claim 11, further comprising a spring operable to compress between the shaft assembly and an interior impact surface of the handle.

13. The jump rope assembly of claim 11, wherein the jump rope section has graduated markings indicating a rope length.

14. The jump rope assembly of claim 11, wherein the jump rope section is a 7×19 stranded cable having an outside diameter of 0.0625 inches and a vinyl coating such that an overall diameter of the jump rope section is 0.120 inches.

15. A jump rope assembly comprising:
- a jump rope section with ends respectively coupled to two handle assemblies, the jump rope section configured to be passed over an individual;
- each handle assembly comprising:
  - a handle having a longitudinal axis, the handle incrementally varying in diameter along the longitudinal axis;
  - a shaft assembly disposed within the handle, wherein: the shaft assembly comprises:
    - a collet fitting operable to receive one of the ends of the jump rope section; and
    - a fitting receptacle configured to receive the collet fitting and tighten the collet fitting about the jump rope section;
  - the shaft assembly is operable to rotate and slide within the handle; and
  - a spring disposed around the shaft assembly, the spring operable to compress between the fitting receptacle and an interior impact surface of the handle.

16. The jump rope assembly of claim 15, wherein:

the collet fitting is a brass fitting; and the fitting receptacle is formed of nylon.

17. The jump rope assembly of claim 15, wherein the fitting receptacle comprises an enlarged opening section to receive the collet fitting.

18. The jump rope assembly of claim 15, wherein the spring relieves tension when the jump rope assembly is in use.

19. The jump rope assembly of claim 15, further comprising an external spring projecting out of the handle configured to prevent kinking of the jump rope section and to relieve strain when the jump rope assembly is in use.

20. The jump rope assembly of claim 15, wherein the one of the ends of the jump rope section is deformed to prevent sliding through the collet fitting.

* * * * *